US006357145B1

(12) United States Patent
James

(10) Patent No.: US 6,357,145 B1
(45) Date of Patent: Mar. 19, 2002

(54) HIGH PERFORMANCE LIGHTWEIGHT GRIND SHOE APPARATUS

(75) Inventor: Brent James, Manhattan Beach, CA (US)

(73) Assignee: Artemis Innovations, Inc., Torrance, CA (US)

( * ) Notice: Subject to any disclaimer, the term of this patent is extended or adjusted under 35 U.S.C. 154(b) by 0 days.

(21) Appl. No.: 09/494,138

(22) Filed: Jan. 28, 2000

Related U.S. Application Data

(63) Continuation-in-part of application No. 09/364,756, filed on Jul. 30, 1999, which is a continuation-in-part of application No. 08/890,595, filed on Jul. 9, 1997, now Pat. No. 6,006,451, which is a continuation-in-part of application No. 08/799,062, filed on Feb. 10, 1997, now Pat. No. 5,970,631

(60) Provisional application No. 60/022,318, filed on Jul. 23, 1996.

(51) Int. Cl.[7] ..... A43B 5/00; A43B 13/22; A43B 13/28

(52) U.S. Cl. ..... 36/115; 36/132; 36/136; 36/73; 36/103; 36/75 R

(58) Field of Search ..... 36/132, 115, 114, 36/107, 72 A, 73, 108, 25 R, 148, 149, 152, 103, 116, 133, 136, 7.1 R, 76 R, 76 C, 72 R, 72 B, 75 R, 75 A, 82

(56) References Cited

U.S. PATENT DOCUMENTS

| | | | | |
|---|---|---|---|---|
| 234,030 | A | | 11/1880 | Hadley et al. |
| 579,577 | A | | 3/1897 | Hanscom |
| 702,476 | A | | 6/1902 | Price |
| 875,560 | A | | 12/1907 | Vaughan |
| 881,079 | A | | 3/1908 | Jolitz |
| 892,152 | A | * | 6/1908 | Harman ..... 36/72 R |
| 1,051,880 | A | | 2/1913 | Glenn |
| 1,056,091 | A | | 3/1913 | Dickson |
| 1,592,692 | A | | 7/1926 | Hackett |
| 1,702,591 | A | | 2/1929 | Brown |
| 2,484,935 | A | | 10/1949 | De Rooy |
| 5,319,866 | A | | 6/1994 | Foley et al. |
| 5,410,821 | A | | 5/1995 | Hilgendorf |
| 5,638,614 | A | | 6/1997 | Hardy |
| 5,970,631 | A | | 10/1999 | Inman |
| 6,006,450 | A | | 12/1999 | Hayes |
| 6,006,451 | A | | 12/1999 | Morris et al. |
| 6,041,525 | A | | 3/2000 | Kelley |

FOREIGN PATENT DOCUMENTS

| | | |
|---|---|---|
| GB | 216903 | 1/1925 |
| WO | PCT/US97/11652 | 7/1997 |

* cited by examiner

*Primary Examiner*—Paul T. Sewell
*Assistant Examiner*—Anthony Stashick
(74) *Attorney, Agent, or Firm*—Fulwider Patton Lee & Utecht, LLP

(57) ABSTRACT

Grind shoe apparatus including a sole mounting a grind plate in the arch area. The grind plate is formed with a downwardly opening concave slide trough and is configured to form clearance spaces at the front and rear thereof. The plate may be formed on the lateral side with an upwardly and outwardly incline side slide surface.

17 Claims, 4 Drawing Sheets

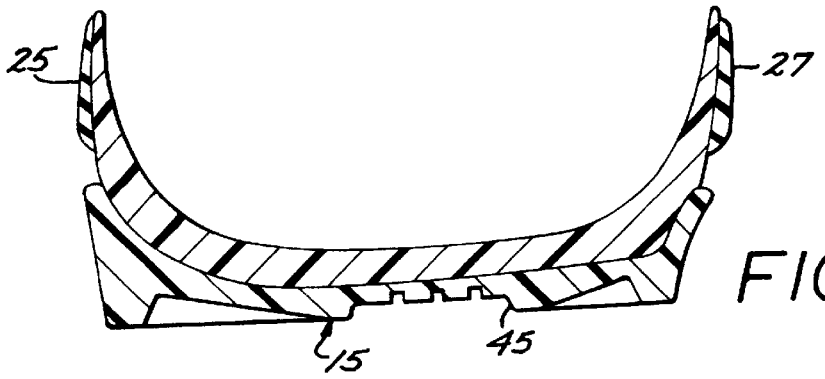
FIG. 4
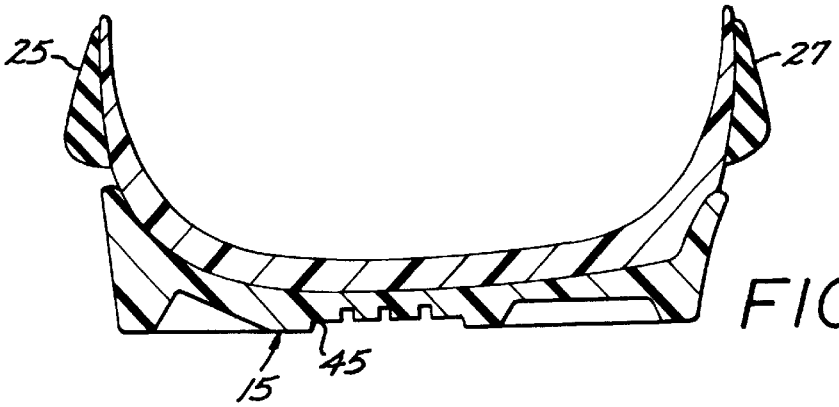
FIG. 5
FIG. 6
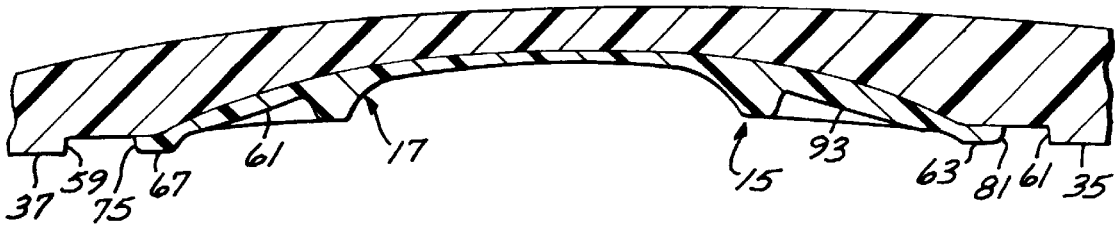

FIG. 7
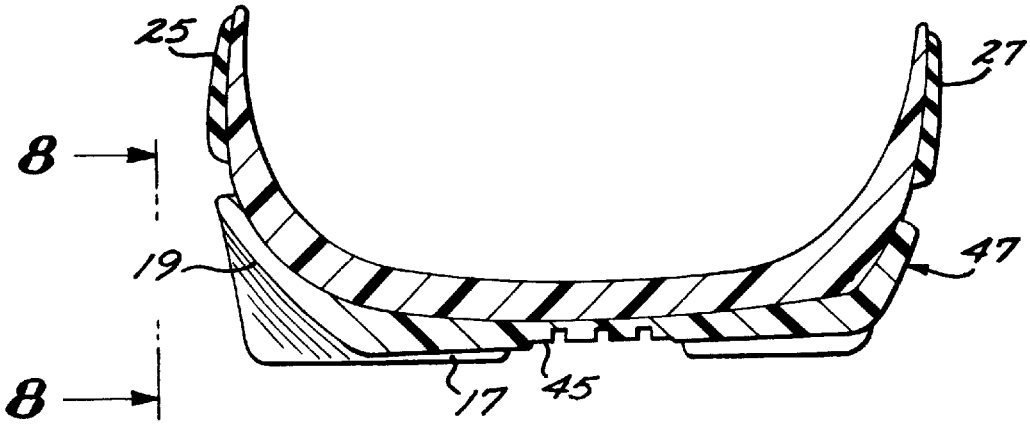
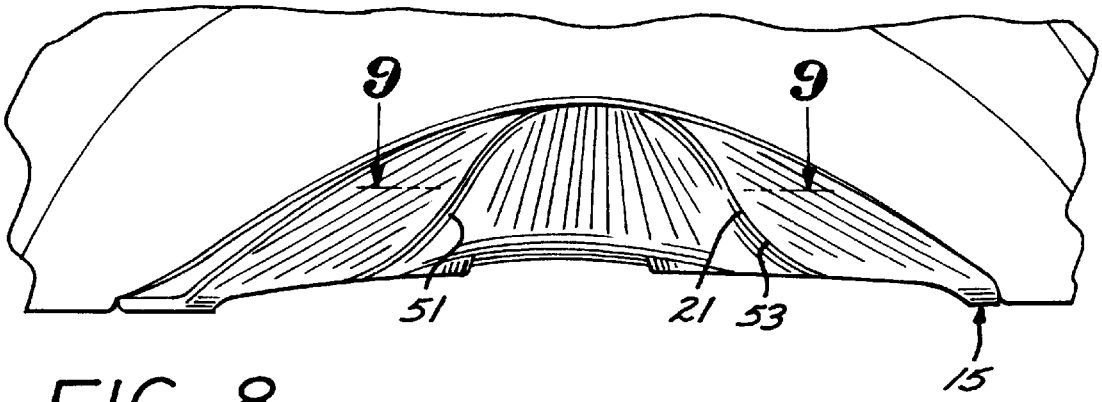
FIG. 8
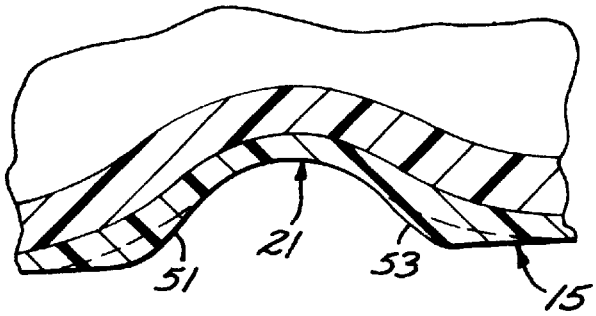
FIG. 9

HIGH PERFORMANCE LIGHTWEIGHT GRIND SHOE APPARATUS

This application is a continuation-in-part of U.S. application Ser. No. 09/364,756, filed Jul. 30, 1999, which is incorporated herein by reference, which is a CIP of Ser. No. 08/890,595, filed Jul. 9, 1997, U.S. Pat. No. 6,006,451, which is a CIP of Ser. No. 08/799,062, filed Feb. 10, 1997, U.S. Pat. No. 5,970,631, and claims benefit of Ser. No. 60/022,318, filed Jul. 23, 1996.

BACKGROUND OF THE INVENTION

1. Field of the Invention

The present invention relates to a grinding shoe having a side plate on the bottom of the sole thereof for sliding along a rail or the like.

2. Description of the Prior Art

Since introduction of grinding shoes by Artemis Innovations Inc., assignee of the present application as disclosed in U.S. Pat. No. 5,970,631, such shoes have gained great popularity among active young athletes. Such shoes have been sold under the trademark SOAP® and typically incorporate a hard slide plate imbedded upwardly in the arch area of an athletic shoe and having a somewhat saddle shape for engaging over a pipe, rail or the like to slide therealong.

Such shoes typically incorporate a recess of a selected configuration raised upwardly in the bottom surface of the shoe for receipt of a grind plate often held therein by mechanical fastener means. It is typical of such shoes that the grind plates incorporate generally cylindrically shaped, downwardly opening concave slide tracks which might curve slightly upwardly on the opposite directions from a longitudinal center line. Such grind plates are satisfactory for introductory uses and perform adequately for even intermediate performance. However, for higher performance athletes who endeavor to perform extreme athletic maneuvers, grind plates configured to accommodate different athletic maneuvers employing inclination of the foot to one side or the other are desirable. One such extreme maneuver is referred to in the art as a "royal" maneuver. This maneuver involves a deep knee bend where the athlete's leg is inclined outwardly to place the weight and forces toward the lateral outside of the plate allowing the athlete to grind along a rail or the like in a high speed controlled highly athletic maneuver. Thus, there exists a need for a grind plate incorporating a grind track which is tailored to control sliding travel over a supporting rail and to cooperate in holding the plate engaged with the underlying slide rail even during the extreme "Royale" maneuvers.

Many prior grind plates have been constructed with relatively heavy thick construction with a relatively high rise in the arch area to endure the high shocks and forces associated with high speed athletic maneuvers involving jumping forcefully onto a support rail. Consequently, many of such prior grind plates require the shoe sole to be of a relatively thick construction in order to accommodate the rise in the plate itself. Such devices thus elevate the wearer's foot above the underlying support surface thus detracting from the preferred stability afforded by what might be thought of as a low center of gravity during athletic maneuvers. Additionally, such relatively thick shoe soles serve to provide a somewhat elevated shoe which can restrict the normal movement associated with walking and running. Consequently, there exists a need for a high performance grind shoe having a low profile configuration to facilitate more normal walking maneuvers and high grade athletic maneuvers.

A number of maneuvers associated with high performance grinding involves speed control. Speed control is often maintained by leaning the shoe over from one side to the other to engage a brake mounted on the shoe with the underlying support surface to apply frictional forces to the shoe. A device of this type is shown in U.S. Pat. No. 6,006,450, assigned to the assignee of the instant application. Such devices incorporate wear resistant brakes sold under the trade name KEVILAR® which is relatively expensive thus driving up the cost of manufacture and retail price of shoes.

Prior shoes have incorporated soles constructed of polyurethane. Such shoes, while enjoying significant commercial success particularly when incorporating a heavy grind plate, can be fairly heavy thus somewhat restricting the more extreme athletic maneuvers. Consequently, it is desirable to employ one or both a lightweight grind shoe sole and a lightweight grind plate. Thus, it is desirable to incorporate a sole constructed with a low specific gravity material and a lightweight grind plate.

SUMMARY OF THE INVENTION

The grind shoe apparatus of the present invention is characterized by a grind plate having a downwardly opening, transversely extending trough projecting generally horizontally from the medial toward the lateral side of the foot but at the lateral side of the foot being configured with an upwardly and laterally outwardly inclined Royale track.

One embodiment of the present invention incorporates a recess of a predetermined configuration formed in the bottom of the shoe sole and having front and back vertical wall sections. The grind plate is configured to be complementally received in such recess and secured thereto with one or the other, or both, of the forward and rearward edges thereof being spaced from the respective forward or rearward wall of such recess.

In another embodiment of the present invention, the grind plate is formed with a relatively shallow rise and is configured with a relatively low rise, a relatively shallow grind track is relatively thin and is bonded to the shoe sole recess to provide a relatively low profile.

Other objects and features of the invention will become apparent from consideration of the following description taken in conjunction with the accompanying drawing.

DESCRIPTION OF THE DRAWINGS

FIG. 4 is a transverse sectional view taken along the line 4—4 of FIG. 2A;

FIG. 5 is a transverse sectional view taken along the line 5—5 of FIG. 2A;

FIG. 6 is a sectional view taken along the line 6—6 of FIG. 2A;

FIG. 7 is a transverse sectional view taken along the line 7—7 of FIG. 2A;

FIG. 8 is a partial side view, in enlarged scale, taken along the line 8—8 of FIG. 7; and FIG. 9 is a longitudinal sectional view taken along the line 9—9 of FIG. 8.

DESCRIPTION OF THE PREFERRED EMBODIMENT

Figure 1:
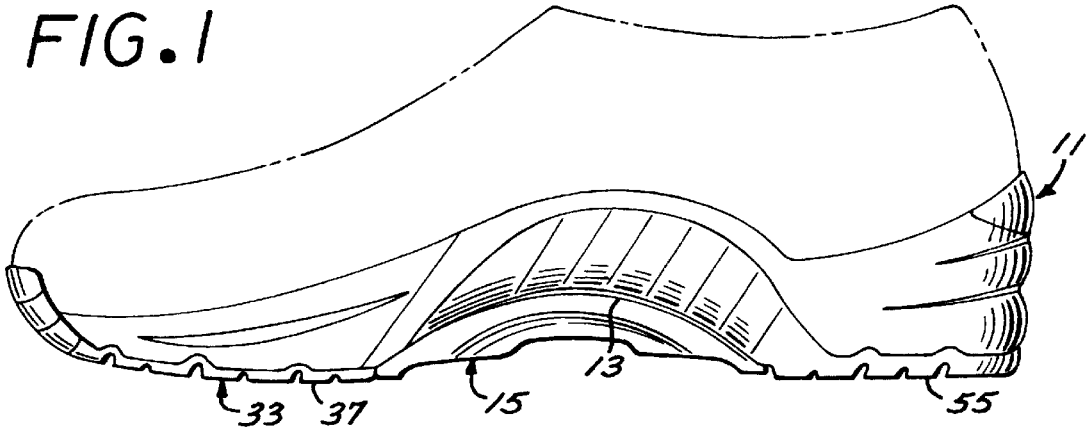
FIG. 1 is a right side view of a high performance grind shoe apparatus incorporating the present invention.
Figure 2A:
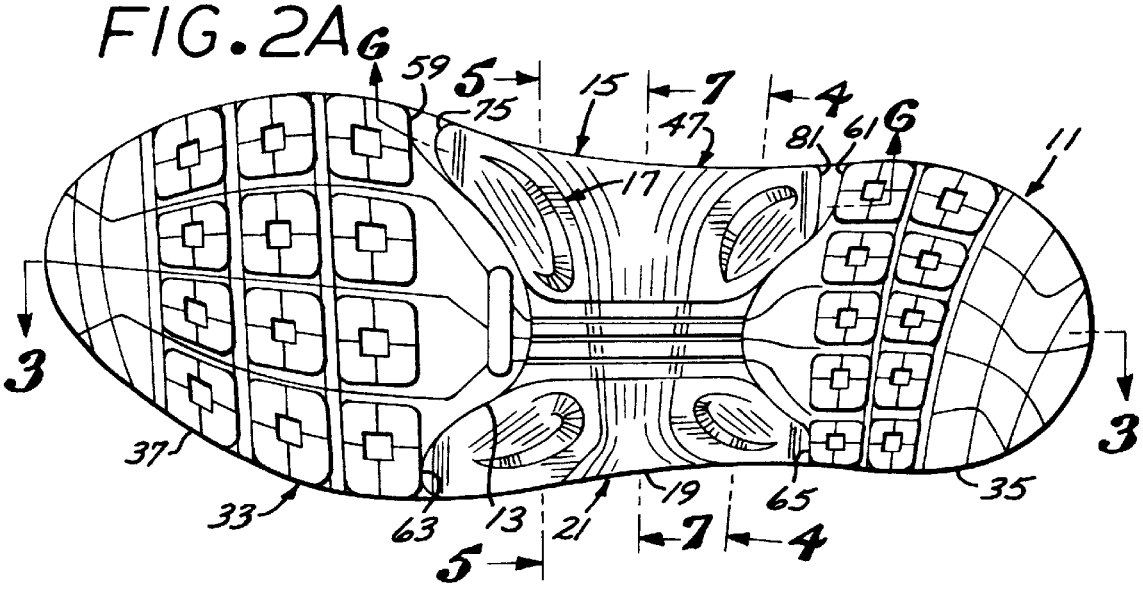
FIG. 2 is a bottom plan view thereof.
FIG. 2B is an enlarged partial bottom plan view similar to FIG. 2A.

Referring to FIGS. 1 and 2A, the high performance grind shoe apparatus of the present invention includes, generally, a cushioning sole 11 having an upwardly raised recess 13 formed in the arch area thereof and projecting transversely. The recess 13 is relatively shallow in the vertical direction. A grind plate, generally designated 15, is configured on its top side to be complementally received in the recess 13 and is configured with a transversely extending upwardly raised trough or grind track, generally designated 17. The grind track 17 diverges longitudinally outwardly as it projects in the lateral direction from the longitudinal center of the sole 11. Such plate includes a medial portion, generally designated 19, which has a relatively horizontal top wall and, at the lateral side of the shoe, curves abruptly upwardly to angle upwardly and laterally outwardly to form what is referred to as a "Royale" track, generally designated 21. The grind plate 15 is bonded on its top side to the recess 13. Mounted on the opposite sides of the shoe sole are respective outwardly protruding rubber brake rails 25 and 27 (FIG. 5).

The shoe sole 11 includes a midsole 31 constructed of either polyurethane or a lightweight plastic known as ethyl vinyl acetate (EVA). While having extremely desirable recoverability from compression forces typically associated with advanced grinding maneuvers, EVA is characterized by having a relatively low specific gravity thus affording extremely lightweight construction. The outsole 33 may be constructed of conventional polyurethane to provide high wear resistance.

Figure 3:
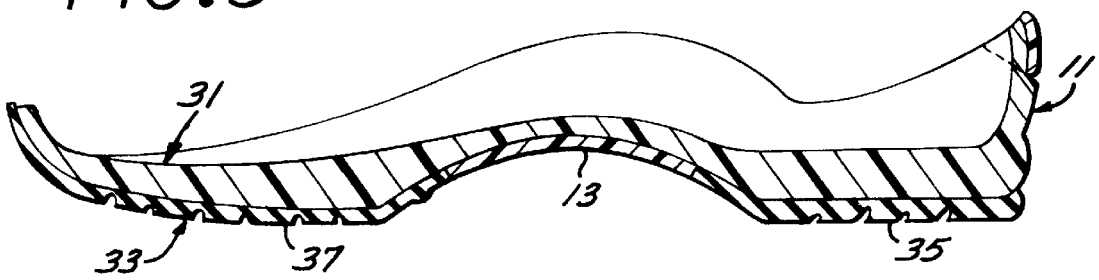
FIG. 3 is a longitudinal sectional view taken along the line 3—3 of FIG. 2A.

With continued reference to FIGS. 1 and 3, the midsole 31 and outsole 33 are configured to provide heel and forefoot tread surfaces 35 and 37, respectively, disposed generally in a horizontal plane. The sole construction is such that the recess 13 rises upwardly in the medial portion of the shoe about 2 cm from the horizontal plane of the forefoot and heel surfaces 37 and 35.

Molded or bonded to the opposite sides of the arch area of the sole 11 are respective crescent shaped rails 25 and 27 which protrude laterally outwardly beyond the vertical planes through the outer edges of the grind plate 15 at least from the forward portion of the arch to the front of the heel to thus provide outwardly disposed high friction brake surfaces to be engaged with the underlying support surface which the shoe is rolled over extensively to one side or the other.

Figure 2B:
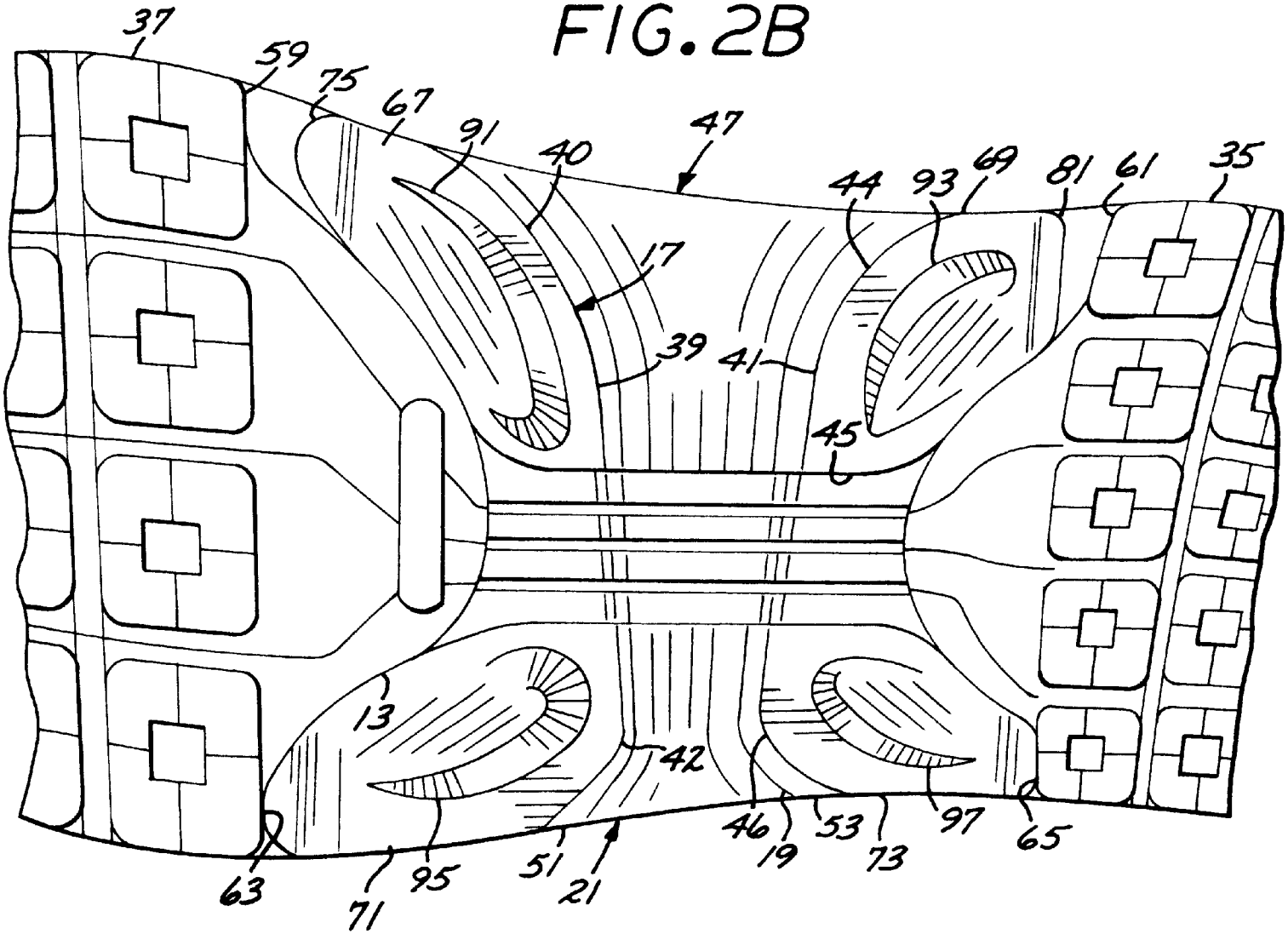

The grind plate 15 is constructed of hard plastic or Nylon, such as Nylon 6 and is relatively low profile, about ½ cm thick, and rising upwardly and configured with the horizontally extending concave track 17 having its top extent spaced vertically upwardly about ½ cm from the horizontal support plane of the sole. The concave track 17 is configured at its front and rear extremities with respectively front and rear walls 39 and 41 (FIG. 2B) which, from a point approximately 1 cm in from the medial side of the foot, angle along the relatively straight lines to converge inwardly from a major width of 4 cm at the medial side to a width of 2 cm at the lateral side of the shoe. It will be appreciated that, as viewed in bottom plan view in FIG. 2B, the front wall 39 curves gradually forwardly at the medial side to form a medial shoulder 40 and more abruptly forwardly at the lateral side to form a small radius shoulder 42. In a similar manner, the back wall 41 curves gradually rearwardly at the medial side to form a larger radius shoulder 44 and more abruptly rearwardly at the lateral side to form a small radius shoulder 46. This construction provides a greater degree of forward and aft movement of the plate on an underlying rail on the medial side when a lesser amount of the athlete's weight is applied to that side of the plate while allowing for some degree of forward and aft shifting of such plate while still engaged with such rail.

Referring to FIG. 7, as viewed in lateral cross-sectional view, the plate is formed with the track 17 extending generally horizontally and is formed centrally with a longitudinally extending, downwardly opening lightening groove 45. Such plate is formed at the medial outer extremity to curve gradually upwardly to form a medial grind rail track 47 for engaging in grinding relationship with the underlying surface when the shoe is rolled over on the medial side. At the lateral side, the grind track curves to angle upwardly and outwardly to form the "Royale" track 21 angling upwardly and outwardly at 45° to the horizontal. This provides a support track which firmly engages the grinding rail during a "Royale" maneuver to thus provide for a firm ride over the support rail. It is significant that the front and back side walls 39 and 41 are relatively close spaced at the lateral side of the concave track 17 defining the root of the "Royale" track 21 to thus afford relatively precise centering of the grind plate over the support rail as the athlete's weight is shifted to the lateral side. The "Royale" track 21 is configured with a convex configuration as viewed in horizontal sectional view and is configured with laterally outwardly extending, forwardly and rearwardly angled front and rear walls 51 and 53 (FIG. 9) to form the track 21 with a concave configuration to maintain that track positively engaged on such rail during the "Royale" maneuver to maintain the shoe centered fore and aft on such rail. This feature is sometimes referred to in the art as "locking" onto the rail. It has been found that the "Royale" track 21 should be angled upwardly and outwardly at an angle of at least about 30° to the horizontal with the ideal angle being about 45° to the horizontal. In the preferred embodiment, the "Royale" track front and back walls 51 and 53 diverge away from one another at an angle of 120° (FIG. 9).

In the preferred embodiment, the recess 13 as viewed in bottom plan view in FIG. 2A is configured at its front and rear extremities with vertical walls about 0.5 cm high and contoured to provide somewhat of crescent shapes to provide laterally oppositely disposed, respective forwardly and rearwardly projecting medial and lateral pad recess sections 59, 61, 63, and 65. The forward pad recess sections 59 and 63 projecting forwardly on the opposite sides of the forefoot section 37 and the rear pad recess sections 61 and 65 project rearwardly on the opposite sides of the heel section 35, as viewed in FIG. 2A.

As viewed in bottom plan view (FIG. 2B), the front and back edges of the grind plate 15 are somewhat crescent shaped to be bowed inwardly at the longitudinal center and form laterally disposed, longitudinally projecting pads 67, 69, 71 and 73 disposed at the four corners thereof to be complementally received in the respective pad recess sections 59, 61, 63 and 65. The respective pads project longitudinally and the medial pads 67 and 69 terminate in respective forward and rear edges 75 and 81 spaced longitudinally from the respective vertical walls of the recess walls 59 and 61 to thereby provide a gap or space between such edges and such vertical recess walls for the purpose to be described hereinafter. In the preferred embodiment, the respective pads 67, 69, 71 and 73 are formed with respective downwardly opening crescent shaped lightening dimples 91, 93, 95 and 97.

In operation, it will be appreciated that the sole 11 will typically be molded to the shoe upper to form the recess 13 of the configuration described hereinabove. The respective rubber brake rails 25 and 27 will be bonded or molded to the opposite sides of the sole. The top side of the plate 15 is complementally shaped to be nested upwardly in such recess 13 with the innermost extremities of such plate recessed upwardly above the horizontal plane to the forefoot and heel sections 37 and 35. The plate, when nested in such recess, will form the respective transversely projecting gaps between the respective longitudinally disposed front and rear edges of the respective front and rear pads 67 and 69 and the confronting vertical edges of the pad recesses 59 and 61. The plate 15 will be bonded into the recess 13 to provide a secure fixation and lightweight construction.

When an athlete dons the shoe, he or she can slide over a grind rail with the rail nested in the support track 17. As an athlete exercises various maneuvers requiring a jumping maneuver onto a rail or the like, it will be appreciated that from time to time the plate 15 will be impacted onto the rail forward or aft of the optimal center and possibly even with, at times, the shoe sole striking the rail immediately forward or aft of the plate. It will be appreciated that athletes typically direct their feet such that the weight on the initial impact is directed toward the medial side of the shoe. From time to time, the shoe will strike the rail on the medial side at or near, or even just forward of the forward edge 75 as the athlete endeavors to maneuver his or her foot more forwardly over the rail to engage in the support track 17. It will be appreciated that, upon such initial contact, any outsole material juxtaposed the forward edge of the plate will contact the rail and, to the extent it is constructed of high co-efficient of friction material will tend to grab or resist sliding movement of the shoe thereby tending to throw the athlete off balance. To this end, the clearance space or gap on the medial side between the forward plate edge 75 and vertical forward wall of the pad recess 59 of the recess 13 will provide some degree of latitude for the athlete to avoid or minimize engagement of the sole outer and consequent grabbing to render resistance of the sliding movement on such rail.

In a similar fashion, should the shoe strike the rail at the rear extremity on the medial side of the shoe adjacent the back end of the plate, the clearance gap or space between the rear edge 81 of such plate and the rear wall of the rail recess 61 will afford some clearance and consequent leeway in maneuverability without grabbing of the outer sole in the heel area. In some embodiments of the present invention, clearance gaps will also be formed on the lateral side of the shoe bottom.

It will be appreciated that the pads 67, 69, 71 and 73 all slope longitudinally and upwardly toward the transverse center of the support track 17 so that a rail engaged thereby will tend to cause the plate 15 to slide relative thereto in a direction which will direct such rail into the support track 17. Assuming a rail is, for instance, first engaged by the forward medial pad 67, it will be appreciated that the upward and rearward inclination of such pad will tend to cause the force of the impact to drive the plate 15 forwardly on the rail causing the rail to be received in the concave track 17 behind the front wall 39 of such track. Such front wall, having a vertical orientation, will tend to lock in over such rail thus affording a positive engagement preventing relative rearward sliding of such plate relative to the rail. This feature is important since the force of such rail reacting to the weight of the athlete is forward of the heel and will often tend to raise the toe somewhat relative to the heel and, without such wall 39, could cause the plate 15 to disengage resulting in a risk of disaster.

With the athlete is a somewhat erect position the plate will slide over such grind rail from contact with the surface of the support track 17. When the athlete approaches a "Royale" maneuver, the shoe will be rolled over onto its lateral side to lay the upwardly and laterally outwardly inclined "Royale" rail 21 on the grind rail to continue the grinding maneuver with such "Royale" track in firm contact. It is significant that, as the user's weight is rolled over to the lateral side of the shoe, the forward and rearward walls 39 and 41 of the support track 17 will tend to relatively precisely center the user's weight fore and aft on such rail in the relatively narrow throat 30 in the concavity provided by the converging "Royale" side walls 51 and 53 to thus hold the grind plate firmly on such rail so long as the athlete's weight is maintained thereon. This allows for a high degree of confidence in making the maneuver and adds to the overall safety.

It will be appreciated by those skilled in the art with the relatively shallow support grind track 17 and thin wall of the grind plate itself, the shoe sole 11 can be relatively thin and the grind plate will provide only minimal elevation thus maintaining a low overall profile. This tends to move the user's foot down close to the contact point between the grind track 17 and the underlying rail surface so as to essentially maintain the user's foot close to the sliding action to thus maintain a high degree of control thereover.

When the shoe is rolled over in one direction or the other to a predetermined degree, one or the other of the brakes 25 or 27 will engage the underlying support surface to generate the frictional resistance and produce a slowing effect.

Various modifications and changes may be made with regard to the foregoing detailed description without departing from the spirit of the invention.

What is claimed is:

1. A high performance lightweight grinding shoe apparatus comprising:

a shoe including a sole formed with an arch area configured with a raised recess of a predetermined configuration having front and back walls;

a grind plate attached to said sole, formed with a top wall configured to be complementally received in said recess and formed on its bottom side with a downwardly opening grind trough slide, said plate formed on at least one end with an edge spaced a selected distance from one of said walls; and said sole is formed on at least one side of said arch area with a laterally projecting brake for, when said trough is positioned on said rail and said shoe is rolled over to said one side, engaging said rail.

2. High performance lightweight grinding shoe apparatus as set forth in claim 1 wherein:

said brake is constructed of rubber.

3. High performance lightweight grinding shoe apparatus as set forth in claim 1 for riding on a rail and wherein:

said sole is constructed in said arch area on the lateral and medial sides with respective lateral and medial brakes for, when said trough slide is engaged on said rail and said shoe is rolled over to the respective lateral or medial side, engage said rail.

4. High performance lightweight grinding shoe apparatus as set forth in claim 3 wherein:

said brakes are constructed of rubber.

5. High performance lightweight grinding shoe apparatus as set forth in claim 3 wherein:

said respective lateral and medial brakes project laterally and medially beyond the respective lateral and medial edges of said grind plate.

6. A high performance lightweight grinding shoe apparatus comprising:

a shoe including a sole formed with an arch area configured with a raised recess of a predetermined configuration having front and back walls;

a grind plate attached to said sole, formed with a top wall configured to be complementally received in said recess and formed on its bottom side with a downwardly opening grind trough slide, said plate formed on at least one end with an edge spaced a selected distance from one of said walls; and said grind plate is formed with said trough slide formed with a horizontally projecting support track for supporting said sole in a substantially erect position and is further formed at the lateral side thereof with a Royale track angling upwardly and outwardly at an angle of at least 30° to the vertical.

7. High performance lightweight grinding shoe apparatus as set forth in claim 6 wherein:

said plate is constructed to angle said Royale track upwardly and outwardly at an angle of substantially 45° to the horizontal.

8. High performance lightweight grinding shoe apparatus as set forth in claim 6 wherein:

said plate is formed with forward and rearward control walls at the respective front and back extremities of said control track for limiting forward and rearward movement, respectively, of a support rail or the like, received in said support track.

9. High performance lightweight grinding shoe apparatus as set forth in claim 8 wherein:

said plate is formed with said control walls projecting from the lateral side of said plate toward the medial side thereof and diverging away from one another.

10. High performance lightweight grinding shoe apparatus as set forth in claim 8 wherein:

said plate is formed with said control walls projecting vertically.

11. High performance lightweight grinding shoe apparatus as set forth in claim 6 wherein:

said plate is formed to configure said Royale track with front and rear walls angling laterally outwardly to diverge away from one another.

12. High performance lightweight grinding shoe apparatus as set forth in claim 11 wherein:

said plate is formed with said Royale front and rear walls angling away from one another at an angle of 120°.

13. A low profile grind shoe apparatus comprising:

a shoe sole configured with a tread surface disposed in a horizontal plane, said sole formed in the arch area with a cylindrically shaped, transversely extending raised recess having a maximum height no greater than 1 cm above said horizontal plane; and a cylindrically shaped grind plate bonded in said recess formed with a thickness no greater than about 0.2 cm, to be configured with a downwardly opening trough slide.

14. A low profile grind shoe apparatus as set forth in claim 13 wherein:

said sole includes a brake on, at least, one lateral side thereof to, when said trough slide is riding on a support surface and said shoe is rolled over to said one lateral side, engage said support surface.

15. A low profile grind shoe apparatus as set forth in claim 13 wherein:

said plate is formed on the lateral side with said trough slide tapering longitudinally and laterally outwardly to form grind shoulders.

16. A low profile grind shoe apparatus as set forth in claim 13 wherein:

said plate is constructed of nylon.

17. A low profile grind shoe apparatus as set forth in claim 13 wherein:

said sole is constructed of ethyl vinyl acetate.

* * * * *

UNITED STATES PATENT AND TRADEMARK OFFICE

CERTIFICATE OF CORRECTION

PATENT NO. : 6,357,145 B1
DATED : March 19, 2002
INVENTOR(S) : Brent James

It is certified that error appears in the above-identified patent and that said Letters Patent is hereby corrected as shown below:

Column 5,
Line 43, replace “rail” with -- pad --.

Signed and Sealed this

Tenth Day of September, 2002

*Attest:*

*Attesting Officer*

JAMES E. ROGAN
*Director of the United States Patent and Trademark Office*